United States Patent [19]

Gerstung

[11] Patent Number: 4,747,779

[45] Date of Patent: May 31, 1988

[54] FORM-KEEPING DEVICE FOR GYMNASTS AND SPRING BOARD DIVERS

[75] Inventor: Seigfried Gerstung, Baltimore, Md.

[73] Assignee: Gym-Thing, Inc., Baltimore, Md.

[21] Appl. No.: 920,612

[22] Filed: Oct. 20, 1986

[51] Int. Cl.[4] ..... A63B 69/00

[52] U.S. Cl. ..... 434/247; 119/96; 128/133; 128/DIG. 15; 272/67; 272/109; 272/131

[58] Field of Search ..... 434/247; 272/126, 131, 272/139, 109, 61, 62, 63, 66, 70, 67; 128/133, 134, 165, DIG. 15; 119/96

[56] References Cited

U.S. PATENT DOCUMENTS

| | | | |
|---|---|---|---|
| 2,450,162 | 9/1948 | Promen | 128/134 |
| 2,498,006 | 2/1950 | Ridill | 272/139 |
| 2,650,590 | 9/1953 | Moore et al. | 119/96 |
| 2,809,042 | 10/1957 | Wasley . | |
| 2,895,471 | 7/1959 | Rollie | 128/133 |
| 3,042,032 | 7/1962 | Vogel | 128/134 |
| 3,297,026 | 1/1967 | Van Pelt | 128/133 |
| 3,380,447 | 4/1968 | Martin | 272/62 |
| 3,535,718 | 10/1970 | Murcott | 128/134 |
| 3,712,271 | 1/1973 | Greathouse | 128/134 |
| 3,903,878 | 9/1975 | Spann | 128/DIG. 15 |
| 3,970,316 | 7/1976 | Westmorland, Jr. | 128/134 |
| 4,239,228 | 12/1980 | Norman et al. . | |
| 4,247,097 | 1/1981 | Schwartz . | |
| 4,273,336 | 6/1981 | Larkey . | |
| 4,457,510 | 7/1984 | Pertschuk . | |
| 4,688,564 | 8/1987 | Kelly | 128/133 |

*Primary Examiner*—John E. Murtagh
*Assistant Examiner*—Caroline D. Dennison
*Attorney, Agent, or Firm*—Cushman, Darby & Cushman

[57] ABSTRACT

A form-keeping device to be worn on extremities of an athlete is disclosed. A first part has a first element for spacing the extremities apart at a predetermined distance. This first spacing element has a first front face covered with pile and a first opposite face which conforms to a body part, such as an ankle of the athlete. A second part has a second element for spacing the extremities apart at the same predetermined distance. This second spacing element has a second front face covered with hook-like projections for engaging with the pile covering the first front face on the first spacing element. The second spacing element also has a second opposite face which conforms to an opposite body part, such as the other ankle of the athlete. Because the hook-like projectins on the second front face of the second spacing element attach to the pile on the first front face of the first spacing element, the extremities, such as the feet and legs of the athlete, are kept together by the form-keeping device of the present invention.

1 Claim, 2 Drawing Sheets

FORM-KEEPING DEVICE FOR GYMNASTS AND SPRING BOARD DIVERS

BACKGROUND OF THE INVENTION

1. Field of the Invention

The invention relates to a teaching aid and, in particular, to a form-keeping device for teaching gymnasts and spring board divers to keep their legs and feet together during a gymnastic exercise and a dive, respectively.

2. Description of the Related Art

Devices which aid in teaching persons to keep their form in different sports are generally old and well-known. For example, particularly in golf, there are various form-keeping devices which wrap around the arms and wrists of a person to aid him or her to learn how to swing a golf club properly. Exemplary form-keeping devices for golfers are shown in U.S. Pat. No. 2,809,042 issued to Wasley in 1957; U.S. Pat. No. 4,239,228 issued to Norman et al in 1980; and U.S. Pat. No. 4,273,336 issued to Larkey in 1981.

Even for exercising, there are known form-keeping devices. For example, a variable weight glove for wearing on one's hand is known in aerobics from U.S. Pat. No. 4,247,097 issued to Schwartz in 1981. Also, a supportive device for wearing on the soles of one's feet is known in calisthenics from U.S. Pat. No. 4,457,510 issued to Pertschuk in 1984.

However, there are no known form-keeping devices for gymnasts and divers and the prior art devices used in other sports are not applicable to gymnastics and diving because of the different movements which are required by the various sports.

SUMMARY OF THE INVENTION

A primary object of the present invention is to provide an aid for teaching a person to keep his or her legs and feet together while learning either a gymnastic exercise or a spring board dive.

A form-keeping device includes pile and hook fasteners like Velcro® for connecting two parts together. The sound created when the two parts are being separated alerts the gymnast and the diver that they are not correctly performing the exercise and the dive, respectively. Also, the resistance experienced by the gymnast and the diver when the two parts of the form-keeping device are separated serves as a reinforcement that the exercise or dive is not being done properly. In other words, both the sound created and the resistance experienced aid to remind the gymnast and the diver that good form requires the perfect alignment of the feet and legs.

To be more specific, the form-keeping device of the present invention comprises two padded, adjustable ankle straps with a Velcro®-like fastening system that sticks two separate parts together when the legs and feet of a gymnast or a diver are brought together. The distinct ripping sound and the resisting experience when the two parts are being separated make the gymnast and the diver aware of any weaknesses in keeping their form relative to their legs and feet.

The form-keeping device is attached to the user's shoes, socks, leotards, or knee pads covering the person's feet, ankles, shins, or knees, respectively. The device may also be strapped around the user's thighs.

Another object of the present invention is not to lock the person's feet and legs together but rather to give them a warning sound and a resistive experience that informs the wearer that he or she is tending to move either the feet or the legs or both apart.

One advantage of the present invention is that, if the user is put into a difficult position while learning a new gymnastic exercise or a spring board dive, he or she can escape from the restraint of the form-keeping device simply by pulling the legs or feet or both apart and is not dangerously locked into a movement-arresting situation.

Another advantage of the present invention is that the novice gymnast and spring board diver are given a cushioned padding at the location where the form-keeping device is secured to the wearer's body so that the learner can comfortably feel when the feet and legs are in proper position.

Other objects and advantages of the present invention will be more readily apparent from the following description.

DETAILED DESCRIPTION OF THE PREFERRED EMBODIMENT

Figure 1:
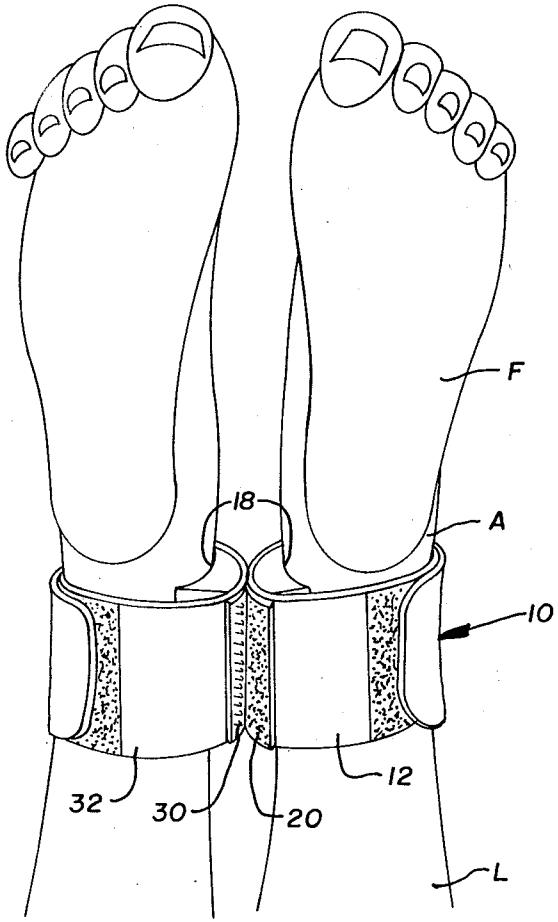
FIG. 1 is a perspective view of the feet of a spring board diver secured together by the form-keeping device of the present invention.

In FIG. 1, the ankles A of a spring board diver are shown to be wrapped by two parts of a form-keeping device 10 so that the feet F and legs L are secured together while a dive is practiced.

Figure 2:
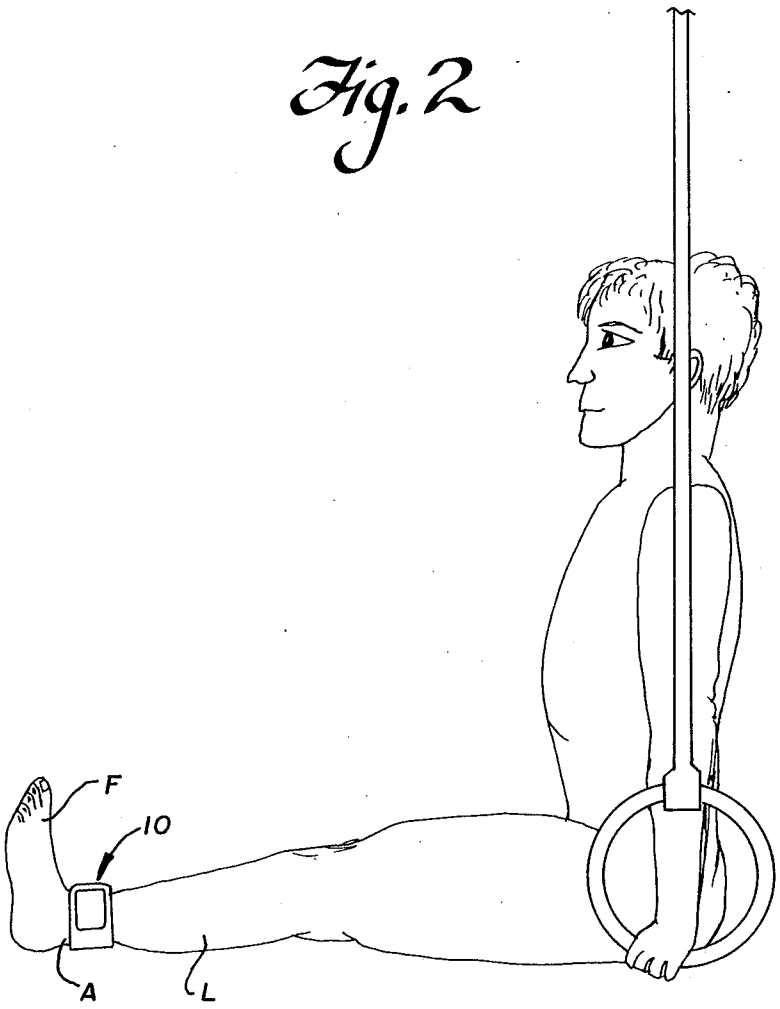
FIG. 2 is a perspective view of a gymnast learning a ring exercise while wearing the form-keeping device of the present invention.

In FIG. 2, the ankles A of a gymnast are likewise shown to be wrapped by the form-keeping device 10 in order to keep the feet F and the legs L of the gymnast together. Although the gymnast is shown practicing a ring exercise, the form-keeping device many also be used for various gymnastic tricks on the parallel bars.

Figure 3:
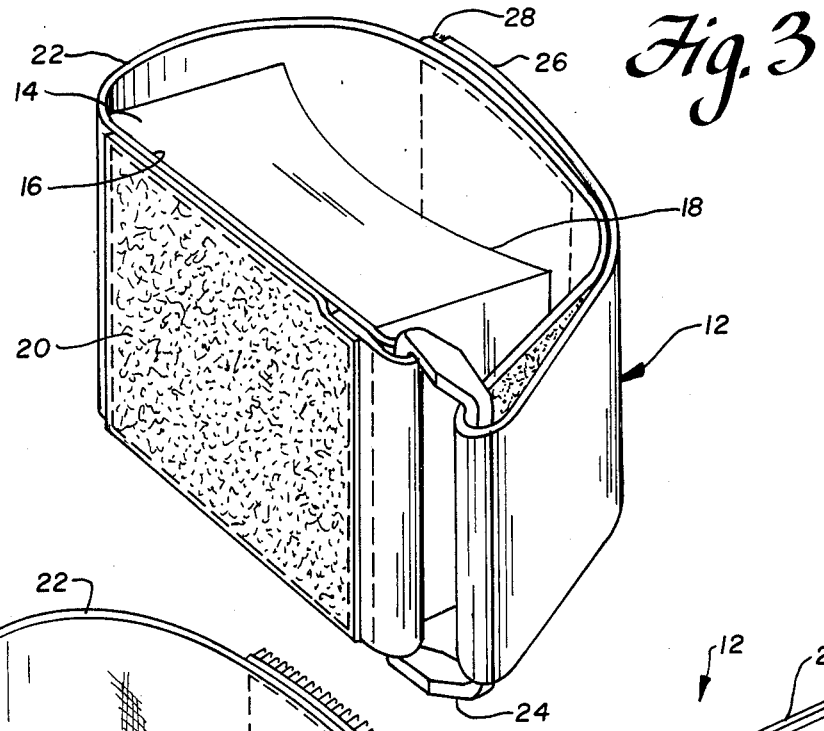
FIG. 3 is a perspective front view of a first part of the form-keeping device of the present invention in which the face thereof is covered by pile.

In FIG. 3, a first part 12 of the form-keeping device 10 is shown in its closed and wrapped position for securement around a person's ankle A.

Figure 4:
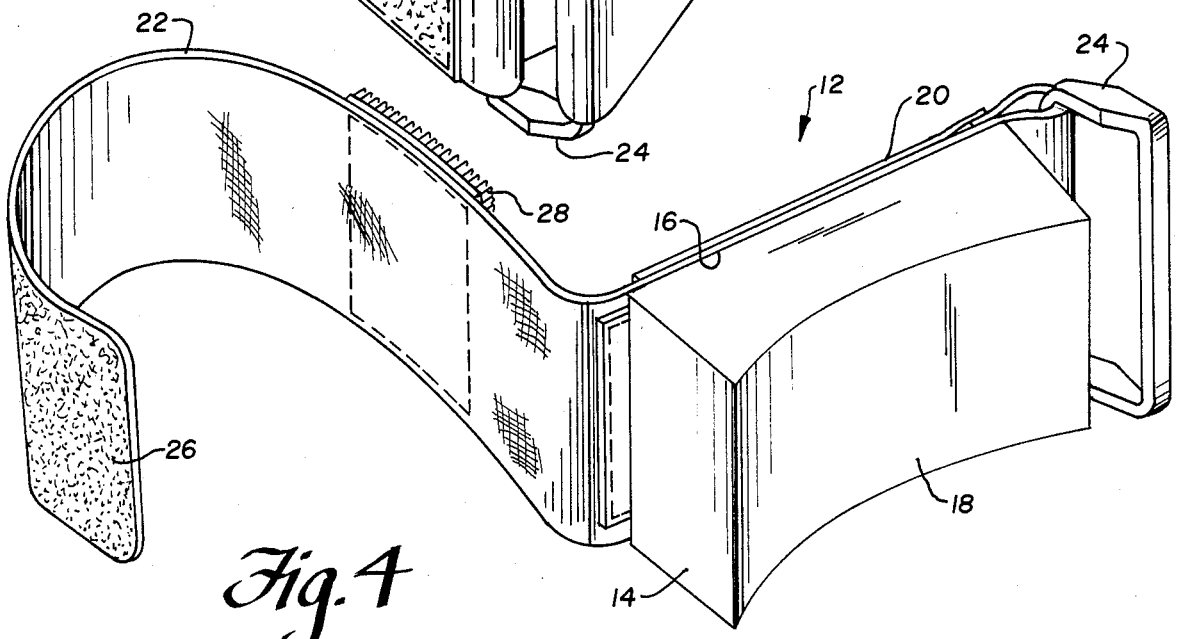
FIG. 4 is a perspective rear view of the same first part of the form-keeping device of the present invention shown in FIG. 3.

In FIG. 4, the first part 12 is shown in its open and unwrapped position. Viewing both FIGS. 3 and 4 together, it may be seen that a block 14 of soft rubbery or foam plastic material has one flat face 16 and one concave face 18 for comfortably contacting the ankle A of a user. Attached to the flat face 16 of the block 14, there is a front face 20 covered with pile such as the type used with Velcro®. A strap 22 is also covered with pile and extends in one direction from one side of the front face 20 and is wrapped around and through a buckle 24 so that a tongue end 26 of the strap 22 may be secured to a patch 28 covered with hook-like projections, such as the type used with Velcro®, for securing the first part 12 of the form-keeping device 10 to the ankle A of a wearer.

Figure 5:
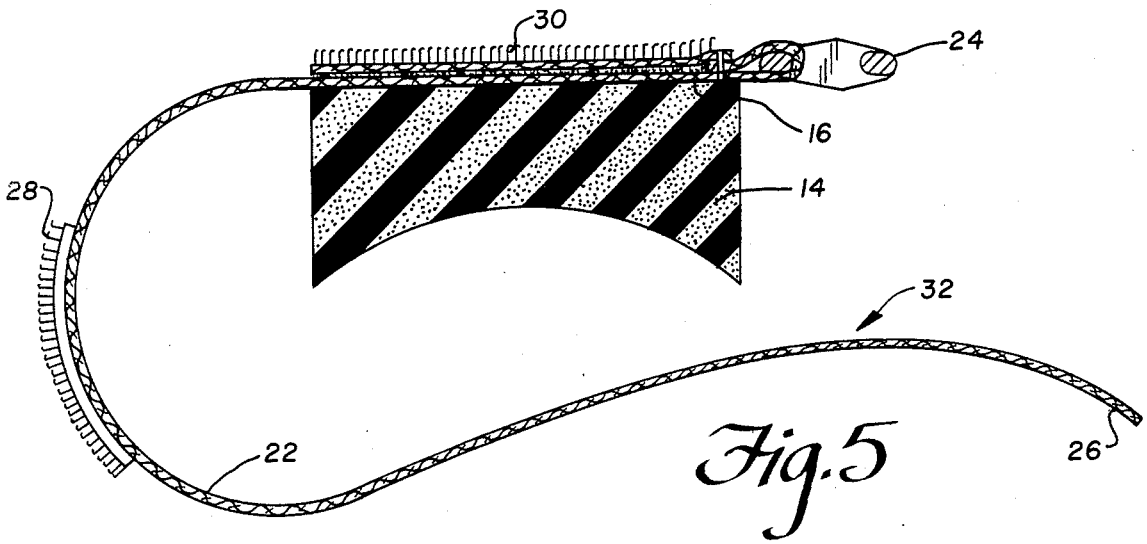
FIG. 5 is a longitudinal sectional view of a second part of the form-keeping device of the present invention in which the face thereof, shown only in elevation, is covered by hook fasteners for connection with the pile on the front face of the first part of the form-keeping device shown in FIGS. 3 and 4.

In FIG. 5, a second part 32 of the form-keeping device 10 is shown in a top plan view in its open and unwrapped position. The second part 32 is identical in its structure to the first part 12 except in one important respect, i.e. instead of a front face 20 covered with pile as in the first part 12, the second part 32 has a front face 30 covered with hook-like projections. Because of this difference in the front faces 20 and 30 of the first part 12 and the second part 32, respectively, the different but cooperating functions of the first part 12 and the second part 32 of the form-keeping device 10 can be accomplished.

Returning to FIG. 1, it may be seen that, when the first part 12 is attached to one ankle A and the second part 32 is attached to the other ankle A of a person, the feet F and the legs L may be brought together so that the front face 20 of the first part 12 and the front face 30 of the second part 32 will interlock because of the pile and hook-like projections which cover the respective front faces 20 and 30, in the same manner as Velcro ®.

Because of the concave faces 18 and the thickness of the block 14, the user's feet F and legs L will be comfortably and sufficiently spaced apart so that the gymnastic and diving forms may be practiced properly. Whenever the person's feet F and legs L start to separate so much that improper gymnastic and diving form will result, the person not only will feel a resistance to such tendency to separate but also will hear a ripping sound caused by the front faces 20 and 30 pulling apart. Both the resistance and the sound will aid the wearer of the form-keeping device 10 in learning to keep the feet F and legs L together so that proper form is maintained until such positioning of the feet and legs become second nature for the gymnast and diver.

To be more specific from a structural standpoint, the form-keeping device 10 is to be worn on the extremities of an athlete. In the preferred embodiment, the first part 12 has the block 14 which functions as a spacing element with the flat surface 16 and the oppositely facing concave surface 18 that conforms to the ankle A of the person. The front face 20 is attached to the flat surface 16 and is covered with pile which functions as a securement means. The strap 22 extends in one direction away from the front face 20 and has a tongue end 26. The buckle 24 extends in an opposite direction away from the front face 20. The patch 28 is attached to the strap 22 at a position intermediate the front face 20 and the tongue end 26. The second part 32 has the same block 14 with a flat surface 16, an oppositely facing concave surface 18 which conforms to an opposite body part of the person, the strap 22 with the tongue end 26, the buckle 24, and the patch 28. The only structural difference between the first part 12 and the second part 32 is that the second part 32 has the front face 30 covered with hook-like projections for engaging the pile covering the front face 20 so that the sticking together of the front faces 20 and 30 will cause the extremities, such as the feet F and the legs L of the athlete, to be kept together.

The foregoing preferred embodiment is considered illustrative only. Numerous other modifications will readily occur to those persons skilled in the pertinent art. Consequently, the disclosed invention is not limited to the exact construction shown and described but is defined by the claims appended hereto.

I claim:

1. A form-keeping device to be worn on extremities of a person comprising:

a first part having a first block with a first flat surface and a first oppositely-facing concave surface for conforming to a part of a first limb of the person, a first front face provided on the first flat surface and covered with pile, a strap attached to the first block and extending in one perimetrically outward direction from the first block and having an outer end provided with a first fastener, a second fastener attached to the first block and extending in an opposite perimetrically outward direction from the first block; and a second part having a second block with a second flat surface and a second oppositely-facing concave surface for conforming to a corresponding part of a second limb the person, a second front face provided on the second flat surface and covered with hook-like projections for disengageably engaging the pile covering the first front face, a strap attached to the second block and extending in one perimetrically outward direction from the second block and having an outer end provided with a first fastener, a second fastener attached to the second block and extending in an opposite perimetrically outward direction from the second block;

the first and second fasteners of said first part being removably securable together around said first limb and the first and second fasteners of said second part being removably securable together around said second limb, with said strap of said second part at least partially encircling said second limb of the person, so as to dispose said hook-like projections on said part of said second limb so that said hook-like projections face in substantially the same direction as is faced by said part of said second limb;

whereby disengageable engagement of the pile on the first front face with the hook-like projections on the second front face will cause said first and second limbs of the person to be disengageably held together at said first and second parts of the device, with a fixed distance between the first and second limbs, which fixed distance is determined by thicknesses of said first and second blocks, said pile and said hook-like projections; and said pile and hook-like projections being adapted to produce an audible ripping-like sound upon reengageable disengagement, if disengaged from an engaged relationship while the person is performing a physical act involving movement of said first and second limbs, for indicating that the person has moved said first and second limbs apart at said parts, by a distance which is greater than said fixed distance.

* * * * *